United States Patent [19]

Fang et al.

[11] Patent Number: 4,960,163

[45] Date of Patent: Oct. 2, 1990

[54] FINE GRAIN CASTING BY MECHANICAL STIRRING

[75] Inventors: Que-Tsang Fang, Murrysville; Michael J. Kinosz, Apollo, both of Pa.

[73] Assignee: Aluminum Company of America, Pittsburgh, Pa.

[21] Appl. No.: 274,309

[22] Filed: Nov. 21, 1988

[51] Int. Cl.[5] ..... B22D 11/00

[52] U.S. Cl. ..... 164/459; 164/134; 164/418

[58] Field of Search ..... 164/134, 418, 459, 468, 164/504

[56] References Cited

U.S. PATENT DOCUMENTS

| | | | |
|---|---|---|---|
| 3,902,544 | 9/1975 | Flemings et al. | 164/485 |
| 4,315,538 | 2/1982 | Nielsen | 164/488 |
| 4,373,950 | 2/1983 | Shingu et al. | 75/68 R |
| 4,430,388 | 2/1984 | Mola | 164/464 |
| 4,434,837 | 3/1984 | Winter et al. | 164/504 |
| 4,457,355 | 7/1984 | Winter et al. | 164/418 |

FOREIGN PATENT DOCUMENTS

| | | | |
|---|---|---|---|
| 64462 | 4/1982 | Japan | 164/459 |
| 23554 | 2/1983 | Japan | 164/504 |
| 157555 | 9/1983 | Japan | 164/459 |

*Primary Examiner*—Richard K. Seidel
*Assistant Examiner*—Edward A. Brown
*Attorney, Agent, or Firm*—David W. Pearce-Smith

[57] ABSTRACT

An apparatus and method of casting a melt into an ingot possessing a fine grain structure. The apparatus comprises (1) a casting mold for holding a reservoir of melt; (2) a partition means located in the melt for dividing the melt into a melt supply reservoir located on a first side of the partition means and a solidification reservoir on a second side of the partition means, the partition means having a communication means for permitting melt to flow from the melt supply reservoir to the solidification reservoir, the partition preventing turbulence from the solidification reservoir to be transferred to the surface of the melt; and (3) means for stirring the portion of the melt located in the solidification reservoir. The means for stirring provides nuclei for grain refinement of the ingot.

53 Claims, 5 Drawing Sheets

Macroetched Grain Appearance of a 6″ Round Ingot Cast With a Single Metal Feed Opening in the Center of the Casting Basin

Macroetched Grain Appearance of a 6″ Round Ingot Cast With Multiple Slanted Feed Openings Around the Prepherel of the Casting Basin

A Typical Macroetched Grain Structures of 6″ Round Ingots Cast by Incorporating Mechanical Stirring for a) Al-2 Cu, and b) Al-1 Si Alloys

A Typical Macroetched Grain Structures of 6″ Round Ingots Cast by Incorporating Mechanical Stirring for a) Al-2 Cu, and b) Al-1 Si Alloys

FINE GRAIN CASTING BY MECHANICAL STIRRING

TECHNICAL FIELD

This invention relates to a method and apparatus for the casting of ingots using mechanical stirring. More particularly, the invention relates to the direct chill casting of fine grain ingots using mechanical stirring.

BACKGROUND ART

Recent developments in grain refinement have included various non-chemical means for refining alloys. These non-chemical means include transmitting ultrasonic waves through the melt and electromagnetic and/or mechanical stirring of the melt. In each of these non-chemical means the liquid alloy is agitated to break up dendrites that would normally form in the melt during casting.

U.S. Pat. No. 3,902,544 issued to Flemings et al discloses a process for making solid or liquid-solid metal composition containing non-dendritic primary solids and to the process for shaping such compositions. The process includes using mechanical stirrers to agitate the liquid metal prior to casting.

U.S. Pat. No. 4,315,538 issued to Nielsen discloses a method and apparatus for continuous casting of alloys for obtaining a fine grain size therein. The improved arrangement comprises a means associated with the die for causing uniform temperatures in the liquid alloy throughout the near freezing area of the die. These means prevent the presence or development of any thermal gradients which are large enough to produce gross directional solidification of the alloy. The means includes focusing the entry of the alloy into the die in a manner which imparts a generally cyclonic motion to the liquid alloy. Nielsen discloses that prior art methods had a smallest grain size normal to casting of 0.063 inch (1500 microns) and that his method produced grain sizes as low as 0.031 inch (750 microns).

U.S. Pat. No. 4,373,950 issued to Shingu et al discloses a process of preparing aluminum of high purity. The aluminum is purified by using a mechanical stirrer to break down dendrites extending from the liquid-solid interface into the liquid phase to release impurities from between the dendrites or between the branches of the dendrites, and dispersing the released impurities throughout the entire body of the liquid phase.

Heretofore, stirrers have not been entirely successful for direct chill casting of ingots. Stirrers create a turbulence in the melt surface which may entrap air and/or surface oxides and pick up hydrogen from the atmosphere. These entrapments lower the integrity and quality of the cast ingot. The manufacturing of semifinished metallurgical cast products such as ingots, billets and plates must be such that the cast products have the best possible degree of physical and chemical homogeneity. This is necessary in order to avoid the occurrence of certain defects in the subsequent operation of transforming such products into other shapes such as sheets and wires.

It would be advantageous, therefore, to provide a method and apparatus that can be readily added to existing casting facilities which permits the use of mechanical stirrers in the direct chill casting of ingots without creating entrapments in the cast ingot.

The principal object of the present invention is to provide a low-cost process for producing high quality alloy ingots with a fine grain size.

Another object of the present invention is to provide a process for producing high quality alloy ingots that do not suffer from the disadvantages of the prior art.

Yet another object of the present invention is to provide a process for producing high quality alloy ingots having refined grain structure which are relatively inexpensive to manufacture.

Still another object of the present invention is to provide a process for producing high quality alloy ingots having refined grain structure which does not require the preliminary addition of refining agents.

Another object of the present invention is to provide a process for producing high quality alloy ingots that can be readily used in existing direct chill casting facilities.

These and other objects and advantages will be more fully understood and appreciated with reference to the following description.

DISCLOSURE OF THE INVENTION

An apparatus and method for casting a melt into an ingot possessing a fine grain structure. The apparatus comprises (1) a casting mold for holding a reservoir of melt; (2) a partition means located in the melt for dividing the melt into a melt supply reservoir located on a first side of the partition means and a solidification reservoir on a second side of the partition means, the partition means having a communication means for permitting melt to flow from the melt supply reservoir to the solidification reservoir, the partition preventing turbulence from the solidification reservoir to be transferred to the surface of the melt; and (3) means for mixing the portion of the melt located in the solidification reservoir. The means for mixing provides nuclei for grain refinement of the ingot.

The method includes the steps of: (1) providing a casting mold for holding a reservoir of melt; (2) providing a partition having a means for permitting liquid melt to flow from the melt supply reservoir area to the solidification reservoir area; (3) providing a means for mixing melt located in the solidification reservoir area; (4) supplying melt into the casting mold, the melt flowing from the melt supply reservoir into the solidification reservoir; (5) mixing the portion of the melt located in the solidification reservoir to provide nuclei for grain refinement of the ingot; and (6) solidifying the portion of the melt located in the solidification reservoir into the ingot having a refined grain structure.

BRIEF DESCRIPTION OF THE DRAWINGS

In the accompanying drawings, like numerals refer to like parts.

DESCRIPTION OF THE PREFERRED EMBODIMENTS

The term "continuous" as used herein refers to the progressive and uninterrupted formation of a cast metal ingot in a mold which is open at both ends. The pouring operation may continue indefinitely if the cast ingot is cut into sections of suitable length at a location away from the mold. Alternatively, the pouring operation may be started and stopped in the manufacture of each ingot. The latter process is commonly referred to as semicontinuous casting and is intended to be comprehended by the term "continuous".

Figure 1:
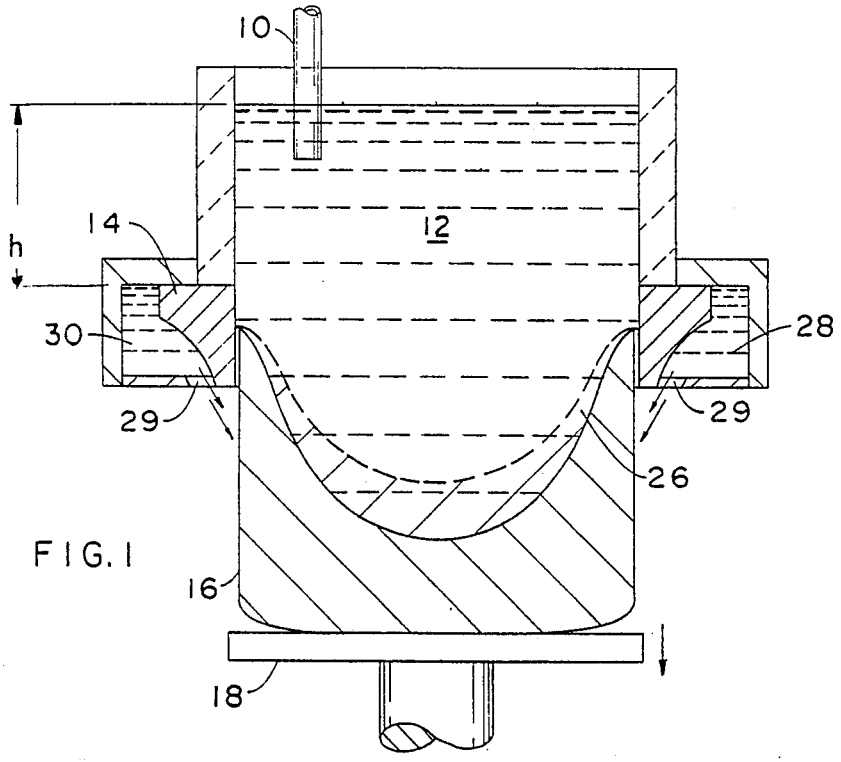
FIG. 1 is a view in vertical section showing a prior art continuous casting apparatus.

Referring first to FIG. 1, there is illustrated a prior art continuous casting apparatus. The apparatus shown in FIG. 1 generally includes a pouring spout 10 for molten metal 12, a casting mold 14 generally defining the transverse dimensions of the ingot 16 being cast. The apparatus also includes a vertically movable bottom block 18 which closes the lower end of the mold 14 at the beginning of the casting operation and by its descent determines the rate at which the ingot 16 is advanced from the mold 14.

In order to insure that the continuous casting operation is understood, a few definitions should be provided at the outset. Metal "head" is defined as distance from the free surface of the molten metal in the casting basin to the top of mold 14. Head is illustrated in FIG. 1 by dimension "h". "Crater" is the term used to define the molten metal pool which exhibits an inverted, generally wedge-shaped configuration from the meniscus of the molten metal level in mold 14 to a location some distance from the exit end of mold 14, which is centrally located in ingot 16. Although the cross-sectional crater profile is often illustrated as a solid line separating molten metal from solid metal, it will be understood by those skilled in the art that there is a mushy zone 26 where the metal is not fully solid yet not really liquid separating the molten and solid phases. For aluminum ingot, such as Aluminum Association Alloy 3003, the mushy zone exists where the metal exhibits a temperature of from about 1190° F. (643° C.) to about 1210° F. (656° C.), and for Aluminum Association Alloy 3004, the mushy zone exists where the metal temperature ranges from about 1165° F. (629° C.) to about 1210° F. (656° C.).

In the typical prior art continuous casting process, molten metal may be transferred to the casting unit directly from a furnace or from a melting crucible The molten metal is poured through a pouring spout 10 or the like into a mold 14 having its bottom closed by a bottom block 18. Flow control devices (not shown) may be provided to minimize cascading and turbulent metal flow and to insure even metal distribution.

The mold 14 is a conventional direct chill casting apparatus and may be externally cooled, usually with a liquid cooling medium such as water. Constructing the mold of a material having high thermal conductivity, such as aluminum or copper, insures that the coolant temperature is transferred as efficiently as possible through the mold wall to the metal to effect solidification.

The coolant, typically water 28, used for direct cooling in the continuous casting unit illustrated in FIG. 1 is provided from the same supply used to cool mold 14. It should be understood that a more flexible cooling arrangement can be obtained from dual cooling, wherein the water supply to the mold is separate from the water supply to the ingot. In the vertical casting unit illustrated in FIG. 1, water 28 is pumped under pressure into the hollow passageway 30 within the mold at a rate which varies with the size of the ingot being cast. The rate also varies with the type of alloy being cast. As long as the water temperature is less than about 90° F. (32° C.) and greater than about 32° F. (0° C.), cooling efficiency is not significantly affected. The water fills passageway 30 and is fed through multiple orifices 29 spaced around mold 14 and extending through the lower inside corner of mold 14. Orifices 29 are constructed and spaced such that the cooling water fed therethrough is directed against the exterior surfaces of ingot 16 forming a uniform blanket of water about the emerging portion of the ingot.

At the initiation of a casting sequence, as the molten metal is poured into the closed, water-cooled mold 14, the metal temperature quickly drops to not much above the liquidus. When there has been sufficient peripheral solidification of ingot 16, bottom block 18 is lowered. Those skilled in the art recognize that the major cooling effect remains outside the mold by direct cooling. Coolant contact during direct cooling must be proper to insure uniformity. Proper contact requires that the direction, rate and pressure of the coolant be relatively constant. Uneven contact will cause uneven heat flow conditions which may adversely affect ingot quality. Light metals, such as aluminum alloys and magnesium alloys, are found particularly adapted to the method of the present invention; however, the principle is adaptable to all alloys including zinc, copper and steel.

At the beginning of the continuous casting operation, the bottom block 18 is lowered at a slow rate. After an ingot has emerged about a few inches from the mold, the casting rate may be increased. The rate that bottom block 18 is moved is not critical to practicing the present invention and may be varied according to the size of the ingot being cast and the type of alloy being cast.

Figure 2:
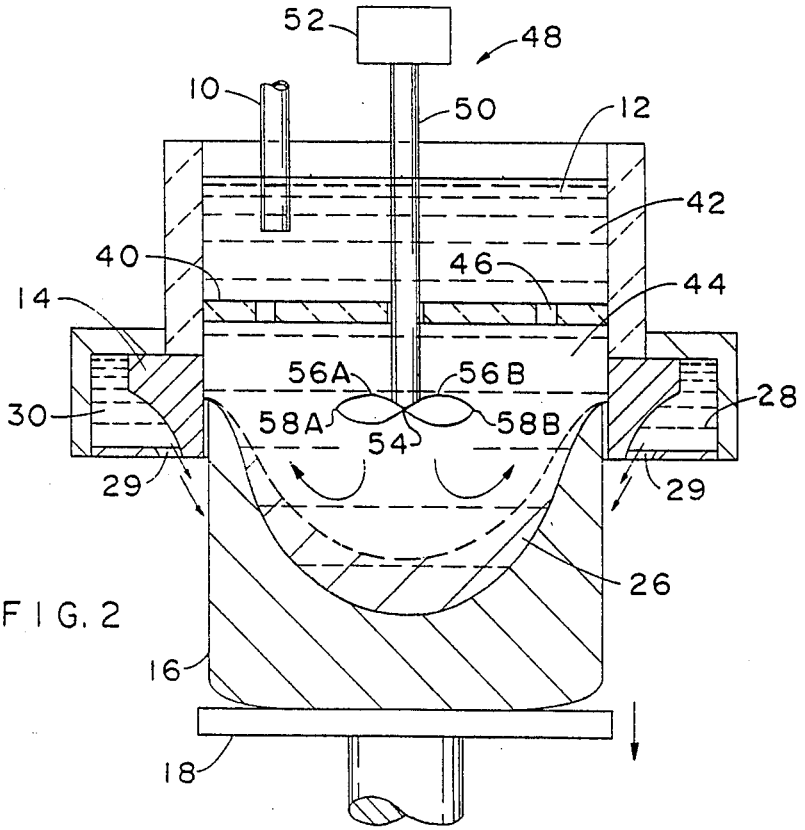
FIG. 2 is a view in vertical section showing an apparatus for practicing the present invention.

FIG. 2 illustrates the improvement of the present invention. As shown in FIG. 2, a separator 40 divides melt 12 into an upper melt supply chamber 42 and a lower melt stirring chamber 44. Separator 40 is positioned in melt 12 so that it is above mushy zone 26 and preferably above casting mold 14. Feed openings 46 allow melt 12 to pass from chamber 42 to chamber 44 as the ingot is being cast and insure a fresh supply of melt is available in stirring chamber 44. Feed openings 46 may be parallel to the axis of forming ingot 16 or they may be skewed or slanted relative to the axis of forming ingot 16. If feed openings are properly skewed, they will contribute to the circular motion of the melt that has been found to break up the forming dendrites.

Mechanical stirrer 48 has a shaft 50 which extends downward from a stirring motor 52 located above the melt level. Shaft 50 extends through separator 40 and terminates at impeller end 54 which is located beneath separator 40 in stirring chamber 44. Shaft 50 is made from graphite. Those skilled in the art will be familiar with other specific materials such as steel and ceramics which may be used with various molten metals.

Blades 56A and 56B extend outward from impeller end 54. The blade span or length is measured from impeller tip 58A to impeller tip 58B as shown in FIG. 2. It is contemplated that the span of blades 56 must be equal to at least 25% of the width or diameter of the ingot to be cast. Of course, the blades may be considerably larger than 25% and the upper limit is set by the inner wall of the mold. The blades must be spaced apart from the inner wall to prevent possible jamming or wear during operation.

The speed of rotation for blades 56 must be such that blade tips 58A and 58B travel at a rate sufficient to impart stirring motion to the melt to break apart dendrites and/or dendrite arms which form upon cooling of the melt and mix the broken pieces in the melt so that they can serve as nuclei for grain refinement as the melt solidifies into the cast ingot. The preferred speed of rotation for the blade tips is at least 10 cm per second. This speed is needed for the effective breaking of dendrites and/or dendrite arms and the simultaneous mixing of the broken pieces in the melt. Speeds in the range of 40 to 1000 rpm are contemplated. The rpm used will depend, in part, on the size of the ingot cast.

Separator 40 prevents the momentum of fluid motion associated with the rotation of blades 56 from carrying melt to the top surface. Heretofore, the deleterious effects of turbulence entrapping air and/or surface oxides and hydrogen pickup in the melt have prevented mechanical stirrers from being used in direct chill casting.

The present invention is illustrated in the following examples:

EXAMPLE 1

Figure 3:
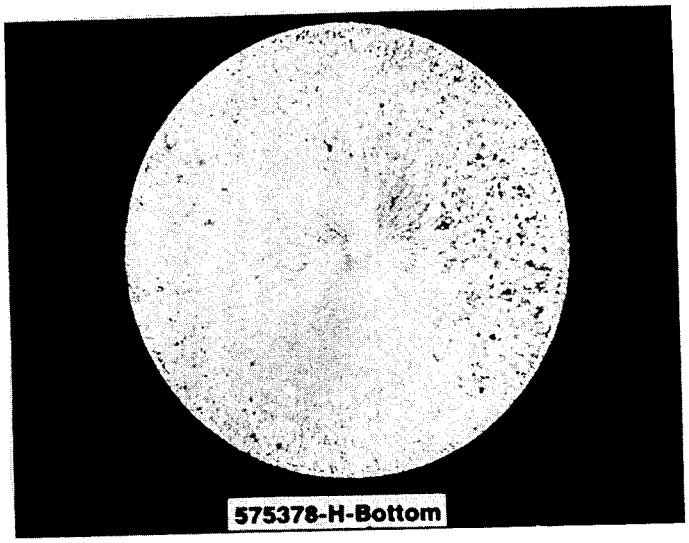
FIG. 3 is a reproduction of a photograph showing the cross section of an ingot cast without the benefit of the present invention.

An ingot was cast in a vertically disposed round water cooled aluminum mold having a diameter of 6 inches (152 mm). Water having a temperature of about 45–50° F. (7–10° C.) was applied to the mold and the descending ingot throughout the casting operation. The aluminum alloy employed in this example had 1% silicon as an alloying element. No chemical grain refiner was added to the melt. The molten metal was supplied to the mold at a temperature of about 1300° F. (704° C.). After the ingot had emerged a total of about 4 inches from the mold, the running casting speed was increased progressively to about 3½ inches per minute. The cast cylindrical ingot was sectioned, and FIG. 3 illustrates the structure of the cast ingot.

EXAMPLE 2

Figure 4:
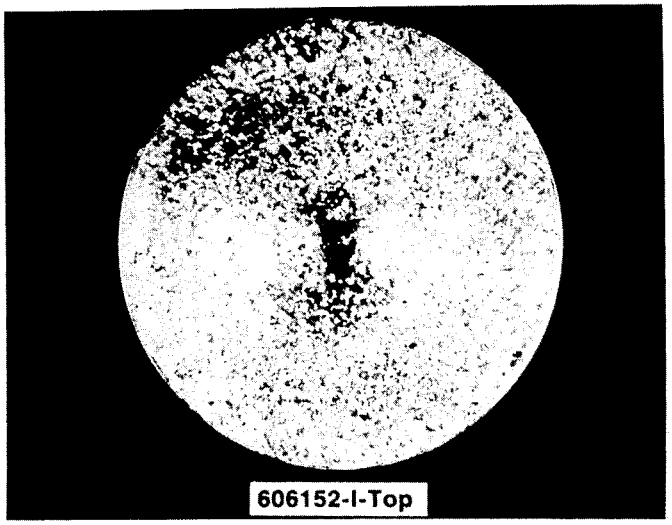
FIG. 4 is a reproduction of a photograph showing the cross section of an ingot cast without the benefit of the present invention.

The same procedure as set forth in Example 1 was followed except that a graphite separator divided the melt into an upper and lower chamber. Sixteen skewed or slanted holes in the separator connected the two chambers. The slanted holes created a slight swirl motion of the molten metal in the lower chamber. The cast cylindrical ingot was sectioned, and FIG. 4 illustrates the structure of the cast ingot. Comparing FIGS. 3 and 4, it is apparent that the ingot of Example 2 did not have the columnar grain in the center core of the ingot. The ingot of Example 2 had a coarse grain structure with the average grain size about two millimeters.

EXAMPLE 3

Figure 5:
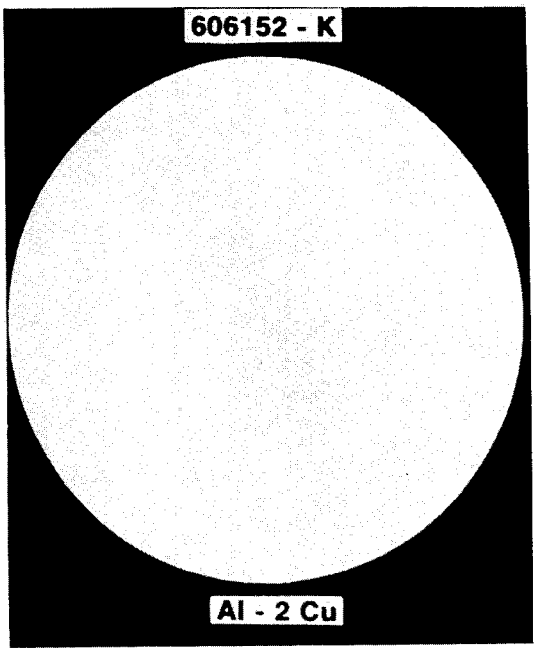
FIG. 5 is a reproduction of a photograph showing the cross section of an ingot cast according to the present invention.

The same procedure as set forth in Example 2 was followed except that a mechanical stirrer mixed the melt as it was being cast. The mechanical stirrer had graphite blades positioned below the separator. The mechanical stirrer rotated at approximately 300 rpm. The blade span from blade tip to blade tip was 3½ inches. The cast cylindrical ingot was sectioned and FIG. 5 illustrates the structure of the cast ingot. The ingot was uniform in appearance and had a homogenous grain size of about 800 microns throughout its entire cross-section.

Surprisingly, the grain size and the variation in grain size of the ingot of Example 3 was much smaller than that one skilled in the art would have expected. It is believed that this is due in part to the separator preventing the broken dendrite pieces from being dispersed throughout the entire body of the melt. The separator concentrated the broken pieces in the stirring chamber where they acted as nuclei for grain growth. It is also believed that the separator, which limited the portion of the melt experiencing turbulence, kept the broken pieces in the near freezing zone and prevented the pieces from being dispersed into the higher temperature upper melt supply chamber where they could be remelted. This increased the amount of broken dendrite pieces available to act as grain nuclei. In addition, the separator, which prevented the dendrite pieces from dispersing throughout the entire melt, may have increased the likelihood that a broken dendrite piece would be further broken by the mechanical stirrer. Thus, the separator may have also increased the number of broken dendrite pieces produced and available to act as grain nuclei.

The separator also acted as an insulator and prevented a reduction of the overall temperature of the melt. This temperature reduction is undesirable.

EXAMPLE 4

Figure 6:
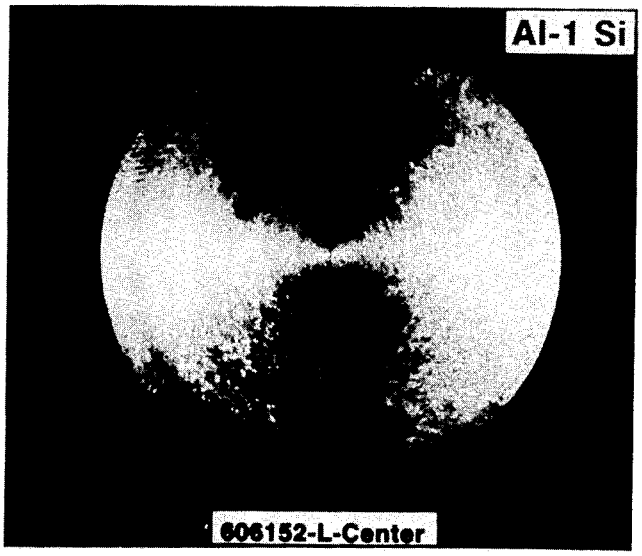
FIG. 6 is a reproduction of a photograph showing the cross section of an ingot cast according to the present invention.

The same procedure as set forth in Example 3 was followed except that the aluminum alloy employed in this example had 2% copper as an alloying element. No chemical grain refiner was added to the melt. The mechanical stirrer had graphite blades positioned below the separator. The mechanical stirrer rotated at approximately 300 rpm. The blade span from blade tip to blade tip was 3½ inches. The cast cylindrical ingot was sectioned and FIG. 6 illustrates the structure of the cast ingot. The ingot was uniform in appearance and had a homogenous grain size of about 400 microns throughout its entire cross section.

It is contemplated that the apparatus of the present invention will be especially valuable in the casting of very high purity alloys that are needed in the electronic industry. One example of the application of such alloys is for electron sputtering targets. Alloys used in electron sputtering targets require a fine grain size (typically under 1000 microns) and a low oxide inclusion content.

It is also contemplated that the apparatus of the present invention will be valuable in the casting of alloys which are difficult to grain refine such as aluminum-lithium alloys and alloys containing zirconium. However, the invention may be practiced on a wide range of alloys. Metals suitable for treatment with the present invention include aluminum, magnesium, copper, iron, nickel, cobalt, zinc, and alloys thereof.

Whereas the preferred embodiments of the present invention have been described above in terms of a continuous vertical casting system for purposes of illustration, it will be apparent to those skilled in the art that numerous variations of the details may be made without departing from the invention. For example, casting may be done in other known casting methods, such as DC casting, or in other casting directions such as the horizontal direction. In addition, the casting need not be continuous but may be intermittent. If the casting is intermittent in nature, the partition and the mechanical stirrer will be connected so that they can be moved simultaneously away from the solidifying melt.

Whereas the preferred embodiments of the present invention have been described above in terms of a mechanical stirrer, those skilled in the art will understand that other stirring means may be employed to create a turbulence sufficient to impart stirring motion to the melt to break apart the dendrites which form upon cooling. For example, an electromagnetic stirrer may be used.

What is claimed is:

1. An apparatus for casting a melt into an ingot possessing a fine grain structure, said apparatus comprising:

a mold, said mold holding a reservoir of melt;

a partition means located in and extending across said melt to divide said melt into a melt supply reservoir located on a first side of said partition means and a solidification reservoir on a second side of said partition means, said partition means having at least one opening for permitting melt to flow from said melt supply reservoir to said solidification reservoir and an additional opening for a mixing means, said partition means preventing turbulence from said solidification reservoir transferring to the gas-exposed surface of said melt; and mixing means for mixing the portion of said melt located in said solidification reservoir, said means for mixing providing nuclei for grain refinement of said ingot.

2. The apparatus of claim 1 which further includes:

a casting basin for holding said melt.

3. The apparatus of claim 1 in which said casting basin is made of graphite.

4. The apparatus of claim 1 in which said partition means is a graphite separator containing at least one opening which allows said melt to flow from said melt supply reservoir to said solidification reservoir.

5. The apparatus of claim 1 in which said means for mixing said melt is a mechanical stirrer.

6. The apparatus of claim 5 in which said mechanical stirrer has a shaft and impeller made of steel.

7. The apparatus of claim 5 in which said mechanical stirrer has a shaft and impeller made of graphite.

8. The apparatus of claim 7 in which said impeller has a blade size that is equal to at least 25% of the diameter of said ingot.

9. The apparatus of claim 1 in which said means for mixing said melt is an electromagnetic stirrer.

10. The apparatus of claim 1 which further includes:

said solidification reservoir defined at one end by said ingot and at its other end by said partition means.

11. The apparatus of claim 1 in which said casting mold is a direct chill casting mold.

12. The apparatus of claim 1 in which said casting mold is a continuous casting mold.

13. The apparatus of claim 1 in which said means for mixing provides sufficient force to break up dendrites forming within said melt.

14. An apparatus for casting a melt into an ingot possessing a fine grain structure, said apparatus comprising:

a mold, said mold holding a reservoir of melt;

a partition means located in said melt for dividing said melt into a melt supply reservoir located on a first side of said partition means and a solidification reservoir on a second side of said partition means, said partition means is a graphite separator containing a plurality of openings for permitting melt to flow from said melt supply reservoir to said solidification reservoir, said partition means preventing turbulence from said solidification reservoir from being transferred to the surface of said melt;

each of said plurality of opening is slanted at an angle designed to create stirring motion in said portion of said melt located in said solidification reservoir; and means for mixing the portion of said melt located in said solidification reservoir, said means for mixing providing nuclei for grain refinement of said ingot.

15. A method of casting a melt into an ingot possessing a fine grain structure, said method comprising the steps of:

providing a casting mold, said mold holding a reservoir of melt having an upper surface;

preventing turbulence from transferring to said surface of said melt by providing a partition means located in said melt for dividing said melt into a melt supply reservoir located on a first side of said partition means and a solidification reservoir on a second side of said partition means, said partition means having a communication means for permitting melt to flow from said melt supply reservoir to said solidification reservoir;

providing a means for mixing the portion of said melt located in said solidification reservoir, said means for mixing providing nuclei for grain refinement of said ingot;

supplying said melt into said mold, said melt flowing from said melt supply reservoir into said solidification reservoir;

mixing the portion of said melt located in said solidification reservoir with sufficient force to break up dendrites forming within said melt as said melt solidifies into an ingot and disperse the broken dendrite pieces to provide nuclei for grain refinement of said ingot; and solidifying said portion of said melt located in said solidification reservoir into said ingot having a refined grain structure.

16. The method of claim 15 in which said step of providing a casting mold includes:

providing a casting basin for holding said melt.

17. The method of claim 16 in which said step of providing a casting basin includes said casting basin being made of graphite.

18. The method of claim 15 in which said step of providing a casting mold includes said melt being an alloy of aluminum.

19. The method of claim 15 in which said step of providing a casting mold includes said melt being an alloy of copper.

20. The method of claim 15 in which said step of providing a casting mold includes said melt being an alloy of magnesium.

21. The method of claim 15 in which said step of providing a partition means includes said partition means being a graphite separator containing at least one opening which allows said melt to flow from said melt supply reservoir to said solidification reservoir.

22. A method for continuously casting ingots possessing a fine grain structure, wherein the molten metal having an upper surface is continuously supplied to an open-ended mold, wherefrom said ingot is continuously withdrawn, wherein liquid coolant is directed to the surface of the ingot emerging from the mold to extract heat therefrom, and wherein casting is initiated by withdrawing from the mold a starting block initially closing the mold, wherein the improvement comprises:

minimizing the transference of turbulence to said upper surface of the molten metal by providing a partition to separate said molten metal into a melt supply reservoir area and a solidification reservoir area, said partition having a means for permitting liquid melt to flow from said melt supply reservoir area to said solidification reservoir area;

providing a means for stirring said molten metal located in said solidification reservoir area;

mixing said molten metal located in said solidification reservoir as said molten metal solidifies into an ingot to provide nuclei for grain refinement of said ingot.

23. The method of claim 22 in which said step of providing a partition includes said partition being a graphite separator containing at least one opening which allows said melt to flow from said melt supply reservoir to said solidification reservoir.

24. The method of claim 22 in which said means for stirring said molten metal is a graphite separator containing at least one opening which allows said melt to flow from said melt supply reservoir to said solidification reservoir.

25. The method of claim 22 in which said step of mixing said molten metal is accomplished using a mechanical stirrer.

26. The method of claim 22 in which said step of mixing said molten metal is accomplished using a mechanical stirrer having a shaft and impeller made of steel.

27. The method of claim 22 in which said step of mixing said molten metal is accomplished using a mechanical stirrer having a shaft and impeller made of graphite.

28. The method of claim 22 in which said step of mixing said molten metal is accomplished using a mechanical stirrer having a blade size that is equal to at least 25% of the diameter of said ingot.

29. The method of claim 22 in which said step of mixing said molten metal is accomplished using an electromagnetic stirrer.

30. A method for continuously casting ingots possessing a fine grain structure, wherein the molten metal is continuously supplied to an open-ended mold, wherefrom said ingot is continuously withdrawn, wherein liquid coolant is directed to the surface of the ingot emerging from the mold to extract heat therefrom, and wherein casting is initiated by withdrawing from the mold a starting block initially closing the mold, wherein the improvement comprises:

providing a means to partition said molten metal into a melt supply reservoir area and a solidification reservoir area to minimize the transference of turbulence from said solidification reservoir into said melt supply reservoir, said partition having a means for permitting liquid melt to flow from said melt supply reservoir area to said solidification reservoir area, said partition means includes a graphite separator containing at least one opening slanted at an angle designed to create stirring motion in said portion of said melt located in said solidification reservoir;

providing a means for stirring said molten metal located in said solidification reservoir area;

mixing said molten metal located in said solidification reservoir as said molten metal solidifies into an ingot to provide nuclei for grain refinement of said ingot.

31. A method comprising:

casting a melt into a mold, with said melt flowing from a melt supply reservoir to a solidification reservoir, said melt having a gas-exposed surface in said melt supply reservoir;

solidifying said melt at a liquid-solid interface in the solidification reservoir;

stirring liquid melt in said solidification reservoir to cause grain refinement in the solidified melt; and preventing turbulence produced in the melt from the stirring being transferred to said surface.

32. The method of claim 31 in which said step of preventing turbulence produced in the melt includes providing a means to partition said molten metal into a melt supply reservoir area and said solidification reservoir area, said partition having a means for permitting liquid melt to flow from said melt supply reservoir area to said solidification reservoir area.

33. The method of claim 31 in which said step of preventing turbulence produced in the melt includes providing a graphite separator containing at least one opening which allows said melt to flow from said melt supply reservoir to said solidification reservoir.

34. The method of claim 31 in which said step of providing a partition means includes said partition means being a graphite separator containing at least one opening slanted at an angle designed to create stirring motion in said portion of said melt located in said solidification reservoir.

35. The method of claim 31 in which said step of casting a melt in a mold includes said melt being an alloy of aluminum.

36. The method of claim 31 in which said step of casting a melt in a mold includes said melt being an alloy of copper.

37. The method of claim 31 in which said step of casting a melt in a mold includes said melt being an alloy of magnesium.

38. The method of claim 31 in which said step of mixing said molten metal is accomplished using a mechanical stirrer.

39. The method of claim 31 in which said step of mixing said molten metal is accomplished using a mechanical stirrer having a shaft and impeller made of steel.

40. The method of claim 31 in which said step of mixing said molten metal is accomplished using a mechanical stirrer having a shaft and impeller made of graphite.

41. The method of claim 31 in which said step of mixing said molten metal is accomplished using a mechanical stirrer having a blade size that is equal to at least 25% of the diameter of said ingot.

42. The method of claim 31 in which said step of mixing said molten metal is accomplished using an electromagnetic stirrer.

43. An apparatus for continuously casting ingots possessing a fine grain structure, wherein the molten metal is continuously supplied to an open-ended mold, wherefrom said ingot is continuously withdrawn, wherein liquid coolant is directed to the surface of the ingot emerging from the mold to extract heat therefrom, and wherein casting is initiated by withdrawing from the mold a starting block initially closing the mold, wherein the improvement comprises:

a means to partition said molten metal into a melt supply reservoir area and a solidification reservoir area, said partition having a means for permitting liquid melt to flow from said melt supply reservoir area to said solidification reservoir area, said partition is a graphite separator containing at least one opening which allows said melt to flow from said melt supply reservoir to said solidification reservoir and each of said at least one opening is slanted at an angle designed to create stirring motion in said portion of said melt located in said solidification reservoir; and a means for stirring said molten metal located in said solidification reservoir area as said molten metal solidifies into an ingot to provide nuclei for grain refinement of said ingot.

44. The apparatus of claim 43 in which said means for stirring said molten metal is a mechanical stirrer.

45. The apparatus of claim 44 in which said mechanical stirrer has a shaft and impeller made of steel.

46. The apparatus of claim 45 in which said mechanical stirrer has a shaft and impeller made of graphite.

47. The apparatus of claim 45 in which said impeller has a blade size that is equal to at least 25% of the diameter of said ingot.

48. The apparatus of claim 46 in which said means for stirring said molten metal is an electromagnetic stirrer.

49. An apparatus for casting a melt into an ingot possessing a fine grain structure, said apparatus comprising:

a mold;

a casting basin for holding a reservoir of melt having an upper surface;

a partition means located in said melt for dividing said melt into a melt supply reservoir located on a first side of said partition means and a solidification reservoir on a second side of said partition means and for minimizing turbulence from said solidification reservoir transferring to said upper surface of said melt, said partition means having a communication means for permitting melt to flow from said melt supply reservoir to said solidification reservoir; and means for mixing the portion of said melt located in said solidification reservoir, said means for mixing providing nuclei for grain refinement of said ingot.

50. The apparatus of claim 49 in which said partition means is a graphite separator containing at least one opening which allows said melt to flow from said melt supply reservoir to said solidification reservoir.

51. An apparatus for casting a melt into an ingot possessing a fine grain structure, said apparatus comprising:

a mold;

a casting basin for holding a reservoir of melt;

a partition means located in said melt for dividing said melt into a melt supply reservoir located on a first side of said partition means and a solidification reservoir on a second side of said partition means, said partition means having a communication means for permitting melt to flow from said melt supply reservoir to said solidification reservoir, said partition preventing turbulence from said solidification reservoir from being transferred to the surface of said melt, said partition means is a graphite separator containing at least one opening which allows said melt to flow from said melt supply reservoir to said solidification reservoir, each of said at least one opening is slanted at an angle designed to create stirring motion in said portion of said melt located in said solidification reservoir; and means for mixing the portion of said melt located in said solidification reservoir, said means for mixing providing nuclei for grain refinement of said ingot.

52. The apparatus of claim 51 in which said means for mixing said melt is a mechanical stirrer.

53. The apparatus of claim 51 in which said means for mixing said melt is an electromagnetic stirrer.

* * * * *

UNITED STATES PATENT AND TRADEMARK OFFICE

CERTIFICATE OF CORRECTION

PATENT NO. : 4,960,163

DATED : October 2, 1990

INVENTOR(S) : Q. T. Fang and M. J. Kinosz

It is certified that error appears in the above-identified patent and that said Letters Patent is hereby corrected as shown below:

Claim 48, Col. 11, line 26 Change "46" to --43--.

Signed and Sealed this

Twenty-fourth Day of December, 1991

*Attest:*

HARRY F. MANBECK, JR.

*Attesting Officer*

*Commissioner of Patents and Trademarks*